United States Patent [19]

Santoro

[11] 4,341,022

[45] Jul. 27, 1982

[54] DETACHABLE ZERO-SET SCOPE MOUNT FOR HAND GUNS AND OTHER FIREARMS

[76] Inventor: Arnold D. Santoro, 419 Brookside Pl., Cranford, N.J. 07016

[21] Appl. No.: 195,171

[22] Filed: Oct. 8, 1980

[51] Int. Cl.[3] ..... F41G 1/38

[52] U.S. Cl. ..... 33/245; 33/250

[58] Field of Search ..... 33/245, 247, 248, 250; 350/10; 42/1 S

[56] References Cited

U.S. PATENT DOCUMENTS

| | | | |
|---|---|---|---|
| 2,043,430 | 6/1936 | Doe | 33/247 |
| 2,567,535 | 9/1951 | Willis et al. | 33/250 |
| 2,649,779 | 8/1953 | Hardgrove et al. | 33/250 |
| 2,942,881 | 2/1960 | Gee | 33/245 |
| 3,559,940 | 2/1971 | Kruzell | 33/250 |
| 3,992,783 | 11/1976 | Dunlap et al. | 33/250 |

FOREIGN PATENT DOCUMENTS

| | | | |
|---|---|---|---|
| 84988 | 8/1921 | Austria | 33/250 |
| 2445230 | 4/1976 | Fed. Rep. of Germany | 33/250 |

*Primary Examiner*—Richard R. Stearns
*Attorney, Agent, or Firm*—Daniel H. Bobis

[57] ABSTRACT

A detachable zero-set scope mount assembly for a hand gun and other firearms has a sized elongated base plate having a planar upper surface, and a lower surface contoured to fit the hand gun, connectors are provided to precisely connect the base plate so that the longitudinal line thereof is in alignment with the longitudinal center line of the hand gun and positioned so as not to interfere with the standard sights on the hand gun. A threaded bore in the longitudinal line of the base plate and at least one tapered guide opening spaced therefrom are formed in the upper surface of the base plate so that a corresponding central opening and downwardly extending tapered projection on the lower planar surface of a scope bracket assembly can be matched and mated thereto, and a manually operated threaded device in engagement with the scope bracket assembly can be threaded into said threaded bore in the base plate to lock the scope bracket assembly with a zero-set scope thereon in assembled position on the hand gun and on unthreading thereof the scope bracket assembly with the zero-set scope thereon can be easily removed from the hand gun.

16 Claims, 9 Drawing Figures

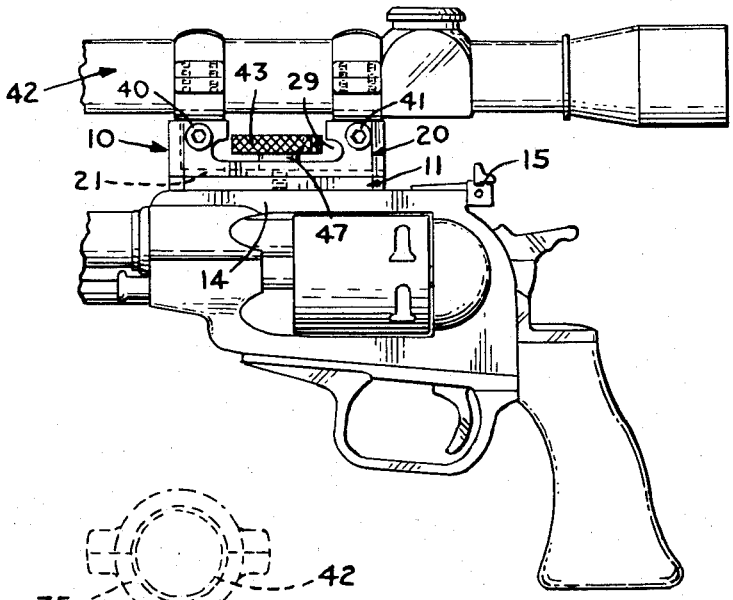
FIG. 1
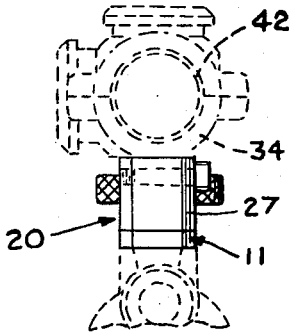
FIG. 2
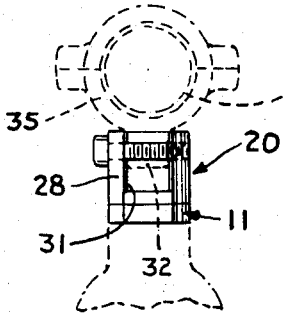
FIG. 3
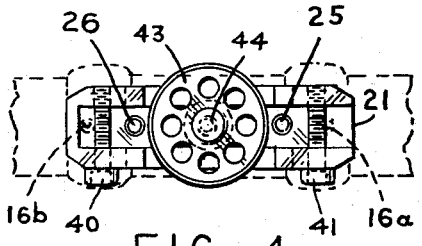
FIG. 4
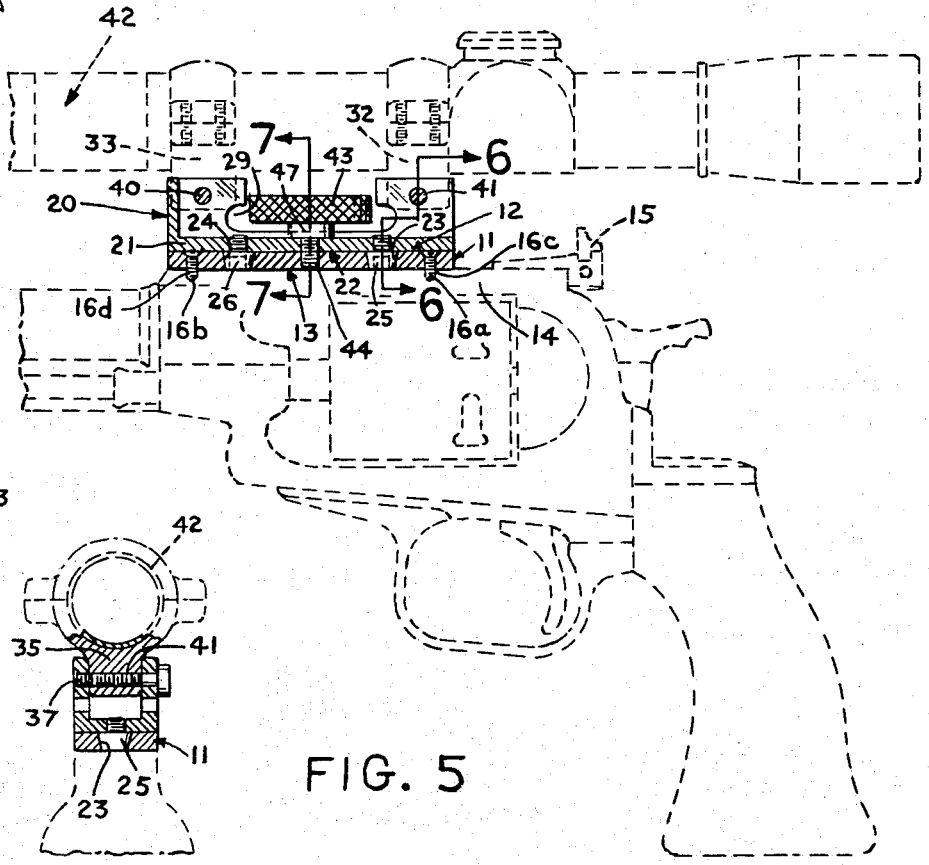
FIG. 5
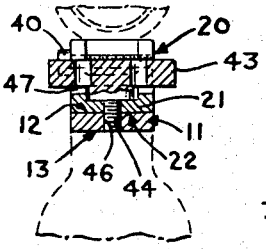
FIG. 7
FIG. 6

DETACHABLE ZERO-SET SCOPE MOUNT FOR HAND GUNS AND OTHER FIREARMS

BACKGROUND OF THE INVENTION

This invention relates generally to firearms and more particularly to a detachable scope mount assembly for hand guns and other firearms.

Telescopic type sights, hereinafter scope sights to be detachably connected on a firearm are a known expedient as is shown and disclosed in U.S. Pat. Nos. 1,835,571, 1,856,549, 2,396,404, 2,407,977, 2,475,383, 2,567,535, 4,085,511 and 4,205,477.

Such scope sights generally contain cross hairs mounted internally therein which are operatively associated with an external means for adjusting the cross hairs to zero the scope sights in assembled position for range, wind, drift, and weight charge of the bullet. When in assembled position on the firearm and properly adjusted the line of sight through the scope sight and the trajectory of the bullet will intersect at the target.

One of the main problems of detachable scope mounts is that if a change in the original zero setting for the scope sight occurs for any reason, the trajectory of the bullet will vary materially from the line of sight. For example, it is known that if the scope sight is deflected as little as 0.001" that the trajectory of the bullet in one hundred yards will vary as much as 1" or more from the target as sighted.

In the known prior art type of detachably mounted scope sights, efforts have been made to overcome this problem. The detachable scope mount assembly in accordance with the present invention is characterized by the fact that once the scope sight is adjusted and zeroed in for the particular associated firearm on which it will be used, the scope bracket assembly holding the scope sight can be connected and detached and the zero-setting for the scope sight will remain unchanged. Therefore the detachable scope mount assembly as described herein is defined as a detachable zero-set scope mount assembly.

The present invention provides an improved detachable zero-set scope mount assembly wherein a sized elongated plate is precisely affixed to the frame of the firearm and has at least one tapered guide opening which is matched and mated with corresponding tapered projections on a scope bracket assembly which holds the scope in assembled position on the firearm. This detachable zero-set scope mount assembly is so positioned on the firearm that when the scope bracket assembly is removed, the base plate does not interfere with the standard sights normally present for use on the firearm.

SUMMARY OF THE INVENTION

Thus the present invention covers a detachable zero-set scope mount assembly for use on hand guns and other firearms having a sized and shaped base plate with an upper surface, the base plate is connected in precise alignment with the center line of the given hand gun and has a threaded bore and at least one tapered guide opening therein in said upper surface disposed relative said center line of the base plate, a scope bracket assembly having a lower surface thereon with an opening therein and a tapered projection in assembled position disposed to precisely align with the upper surface of the base plate and the at least one tapered guide opening therein, and means are provided for detachably connecting the scope bracket assembly to the base plate to fix the same in assembled position thereon.

Accordingly, it is an object of the present invention to provide a compact sturdy scope mount assembly which has a relatively simple and improved means for detachably connecting said scope mount assembly to the frame of a hand gun and other firearms without changing the zero setting for the scope sight mounted in the scope mount assembly.

It is another object of the present invention to provide on a detachable zero-set scope mount assembly with interengaging parts which are connected to each other by a relatively simple means and in assembled position are fixed to prevent any relative transverse or longitudinal movement therebetween.

It is a still further object of the present invention to provide a detachable scope mount assembly which may be readily attached to the frame of a great majority of the conventional commercial firearms currently on the market.

It is still another object of the present invention to provide a detachable scope mount assembly for a hand gun in which the portion which normally is fixed to the hand gun and permits the scope bracket assembly to be detached and removed therefrom will not interfere with the use of the standard or open sights on the associated hand gun when the scope bracket assembly and the scope thereon are removed from assembled position.

Other objects and advantages will become more apparent from the following description made in conjunction with the accompanying drawings wherein:

DESCRIPTION OF THE FIGURES

FIG. 1 is a side view of a portion of a hand gun showing also in side elevation the detachable zero-set scope mount assembly in accordance with the present invention mounted thereon.

FIG. 2 is a front end view of the detachable zero-set scope mount assembly and a fragment of the frame of the hand gun shown in FIG. 1 of the drawings and with the scope sight phantomized in assembled position.

FIG. 3 is a back end view of the detachable zero-set scope mount assembly and a fragment of the frame of the hand gun as shown in FIG. 1 of the drawings and with the scope sight phantomized in assembled position.

FIG. 4 is a top view of the detachable zero-set scope mount assembly with the scope sight removed and a fragment of the frame of the hand gun as shown in FIG. 1 of the drawings.

FIG. 5 is a side elevation similar to the side elevation shown in FIG. 1 of the drawings with the main elements of the detachable zero-set scope mount assembly shown in vertical section.

FIG. 6 is a cross-section taken on line 6—6 of FIG. 5.

FIG. 7 is a cross-section taken on line 7—7 of FIG. 4.

Referring to the drawings FIG. 1 shows a hand gun generally designated 1 having a detachable zero-set scope mount generally designated 10 connected for operative use thereon.

Figures 8, 9:
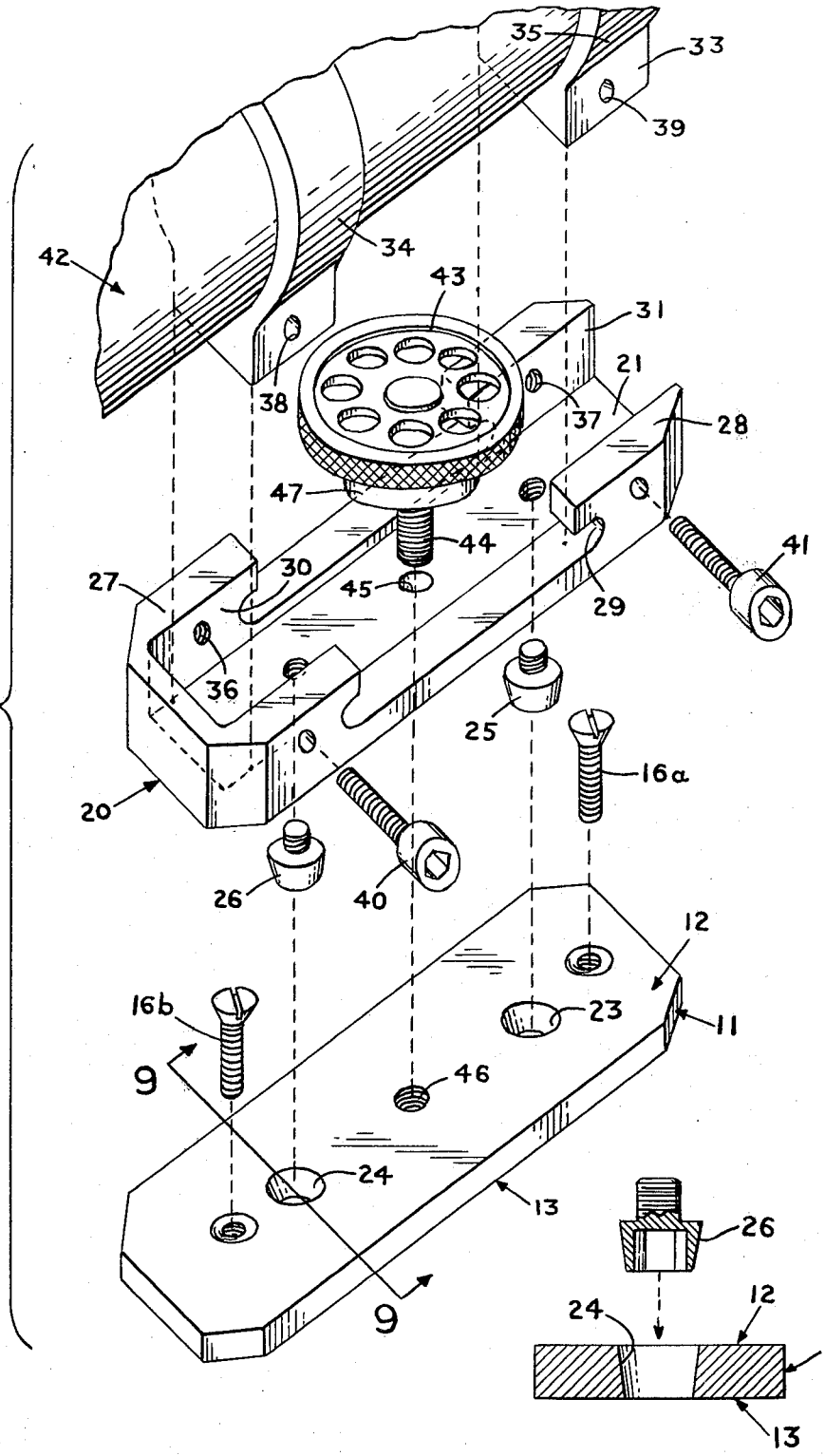
FIG. 8 is an exploded perspective view of the detachable zero-set scope mount assembly as shown in FIG. 1 of the drawings.
FIG. 9 is a cross section taken on line 9—9 of FIG. 8 showing one tapered guide opening in the base plate of the detachable zero-set scope mount assembly shown in FIG. 1 and the tapered projection element on the scope bracket assembly associated therewith.

While the detachable zero-set scope mount assembly in accordance with the present invention is illustrated and shown as applied to a hand gun those skilled in the art will recognize that it is equally applicable to any type of firearm wherein sighting through a scope sight will increase the effectiveness and accuracy of the use of the particular firearm.

In the case of hand guns a detachable scope sight in accordance with the present invention if properly aligned for the particular type or grade of ammunition can improve the accuracy of a hand gun up to 150".

The detachable zero-set scope mount assembly in accordance with the present invention consists generally of three parts. The first part is a sized base plate 11 which is an elongated member having, an upper planar surface 12, and a lower surface 13 which will be shaped to fit the gun frame 14 as illustrated in FIGS. 1, 5, 6 and 7 of the drawings.

It will be understood that the lower surface can take any desired shape but in order to properly align the base plate 11 it is desirable that it be sized in length and shaped on its lower surface to fit snugly to the upper frame 14 of the particular gun to which the detachable zero-set scope mount assembly will be attached.

The base plate 11 will be disposed so as not to interfere with the open or standard sights 15 on the particular gun to which the detachable zero-set scope mount assembly 10 is being affixed by means of threaded members as at 16*a* and 16*b*.

The threaded members 16*a* and 16*b* are shown in alignment with each other, are counter sunk and are aligned with threaded bores as at 16*c* and 16*d* in the frame 14 of the hand gun to precisely align the longitudinal axes of the base plate 11 with the longitudinal center line of the hand gun.

The second part of the detachable scope mount 10 in accordance with the present invention is a scope bracket assembly designated 20 which is an elongated blocklike member having a lower section as at 21 which has a lower flat planar surface thereon as at 22 disposed to fit in assembled position and engage the upper flat planar surface 12 of the base plate 11.

Additionally, in the illustrated embodiment as shown at FIGS. 5, 6, 8 and 9 of the drawings, the base plate is shown as having a pair of spaced tapered and aligned bores as at 23 and 24 which are tapered at an angle preferably of 17° although this can vary within ±5° depending on the size of the particular detachable zero-set scope mount assembly being affixed to a given firearm.

The scope bracket assembly 20 will have a corresponding pair of tapered projections extending downwardly from the lower face 22 of the scope bracket assembly as shown at 25 and 26 so that in assembled position, the aligned pair of spaced downwardly extending projections 25 and 26 will fit in and snugly engage the spaced conical tapered bores 23 and 24.

It will be understood that while conically tapered bores and projections are shown at 23, 24, 25, and 26 disposed in alignment with the longitudinal center line of the base plate 11 that other suitable forms of attaching means, not shown, can be utilized to accomplish the same alignment as for example by offsetting the conical tapered bores from the center line with suitable accuracy so that when the scope bracket assembly 20 is connected to the base plate 11 it will provide the desired alignment for the scope generally designated 42.

The scope bracket assembly is formed, shaped or machined so as to provide spaced scope bracket supports as at 27 and 28 and to define therebetween a central space as at 29. Scope bracket supports 27 and 28 contain milled slots 30 and 31 to receive therein the respective bracket connecting members as at 32 and 33 of the scope brackets generally designated 34 and 35. In order to connect the scope brackets 34 and 35 into the milled slots 30 and 31, threaded bores 36 and 37 extend transversely through the scope bracket supports 27 and 28 and in assembled position align with bores as at 38 and 39 on the bracket connecting members 32 and 33. Suitable threaded nuts as at 40 and 41 can be threaded into the threaded bores 36 and 37 to hold the scope brackets 34 and 35 in assembled position.

The scope brackets 34 and 35 are conventional brackets having the lower half fixed to the bracket connecting members 32 and 33 and the upper half being removable to permit the scope 42 to be assembled in position therein all of which is shown in FIGS. 1, 5 and 8 of the drawings.

The third part of the detachable scope mount assembly in accordance with the present invention is a connector in the form of a manually operable thumb screw 43 having an enlarged head which lies in the central space 29 in the scope bracket assembly 20 to facilitate easy access thereto and to permit the threaded shaft 44 thereon to extend through an opening 45 in the scope bracket assembly 20 for engagement with threaded bore 46 in alignment therewith in the base plate 11.

The thumb screw 43 is further provided with a shoulder 47 about the threaded shaft 44 so that when the thumb screw 43 is inserted through the opening 45 and engages the aligned threaded bore 46 in the base plate 11, it can be threaded to tightly force the scope bracket assembly 20 and more particularly the lower face 22 and projections 25 and 26 into engagement with the upper face 12 and tapered conical projections 23 and 24 on the base plate 11.

It will be understood that the invention is not to be limited to the specific construction or arrangement of parts shown but that they may be widely modified within the invention defined by the claims.

What is claimed is:

1. A detachable zero-set scope mount assembly for use on hand guns having a barrel and an upper supporting surface and other like firearms comprising, a. a base plate means having an upper surface, and a lower surface adapted to fit the upper supporting surface of the associated hand gun, b. means for connecting the base plate means to the upper supporting surface to precisely align the longitudinal center line thereof with the center line of the barrel of the associated hand gun, c. said base plate means having at least one tapered guide opening in the upper surface disposed in predetermined spaced relation to the connecting means and to the center line of the base plate means, and threaded bore means at the mid point of the longitudinal center line of said base plate means, d. scope bracket assembly means having, a lower surface, and a depending tapered projection, in said lower surface, and e. detachable means disposed to engage the scope bracket assembly means and to so connect and to reconnect the same into the threaded bore of the base plate means that the lower surface of the scope bracket assembly means and the depending tapered projection are in precise alignment with the upper surface of the base plate means and the at least one tapered guide opening.

2. A detachable zero-set scope mount assembly for hand guns having a barrel and an upper supporting surface and other like firearms comprising;

a. base plate means having, a generally planar upper surface and a lower surface adapted to fit the point of connection to the upper supporting surface of the associated hand gun so as to be in longitudinal alignment with the barrel of the hand gun and not interfere with the use of the standard sights on said hand gun, b. connecting means on said base plate means to connect the center line of said base plate means in alignment with the longitudinal center line of the barrel of said hand gun, c. said base plate means having a threaded bore at the midpoint of the longitudinal center line of the upper surface of said base plate means, and at least one tapered guide opening formed in said upper surface a spaced distance from said threaded bore and from the center line of the base plate means, d. scope bracket assembly means having, means for connecting a scope therein to permit the same to be zero-set in assembled position therein, and a generally planar lower face to fit the upper face of the base plate means when said scope bracket assembly means is positioned thereon, e. said scope bracket assembly means having an opening and at least one depending tapered projection formed on said lower surface of the scope bracket assembly means so that in assembled position said opening and the respective at least one tapered projection are matched and aligned to the threaded bore and the at least one tapered guide opening on the upper surface of the base plate means, and f. detachable means in engagement with the scope bracket assembly means to extend through the opening therein for detachable engagement with the threaded bore in the base plate means to permit removal thereof from and replacement on the said hand gun without disturbing the zero setting of the scope in the scope bracket assembly means.

3. A detachable zero-set scope mount assembly for hand guns having a barrel and an upper supporting surface and other like firearms comprising;

a. sized elongated base plate means including, a generally planar upper surface, and a shaped lower surface adapted to fit the upper supporting surface of the associated hand gun at a point of connection thereon in longitudinal alignment with the barrel of the hand gun so as not to interfere with the use of the standard sights on said hand gun, b. connecting means operatively associated with said base plate means to symmetrically align the same with the longitudinal center line of the barrel of the associated hand gun, c. said base plate means having a threaded bore in said upper surface at the midpoint along the longitudinal center line thereof, and at least two spaced tapered guide openings in said upper surface each disposed in predetermined spaced relation to the threaded bore, d. scope bracket assembly means having, a generally planar lower surface adapted to fit the upper surface of the base plate means, and a bracket means for connecting a scope therein to permit the same to be zero-set in assembled position symmetrical to the barrel of the associated hand gun, e. said scope bracket assembly means having, an opening, and depending tapered projections formed on said lower surface of the scope bracket assembly means so that in assembled position said opening and the respective depending tapered projections are matched and aligned to the threaded bore and said spaced tapered guide openings in base plate means, and f. a detachable connector including, a shoulder means for engagement with the scope bracket assembly means, and a threaded screw to extend through the opening in the scope bracket assembly means for detachable engagement with the threaded bore in the base plate means to permit quick and easy removal thereof from and replacement on the hand gun without disturbing the zero-setting of the scope in the scope bracket assembly means.

4. In a detachable scope mount assembly as claimed in claim 3 wherein the size of the base plate means and the connecting means thereon complements the situs available for the point of connection to the associated hand gun.

5. In a detachable zero-set scope mount assembly as claimed in claim 3 wherein the connecting means for the base plate means includes, threaded and aligned bores disposed in the center line of the base plate means, and counter sunk threaded members for connecting the base plate means to the associated hand gun.

6. In a detachable zero-set scope mount assembly as claimed in claim 3 wherein;

a. said scope bracket assembly means has spaced bracket holders which define a central space therebetween and the opening communicates at one end with the central space, b. the detachable connector has, an enlarged manual knob thereon disposed in said central space, and c. said bracket means for the scope are mounted in said bracket holders respectively.

7. In a detachable zero-set scope mount assembly as claimed in claim 3 wherein;

a. said scope bracket assembly means includes, an elongated member and said generally planar lower face formed on said elongated member, b. spaced bracket holders formed on said elongated member to define a central space therebetween and said opening having one end in communication with the central space formed in said elongated member, and c. said detachable connector having, an enlarged manual knob thereon disposed in said central space.

8. In a detachable scope mount assembly as claimed in claim 3 wherein, a. said spaced tapered guide openings are disposed respectively on opposite sides of the threaded bore in the upper surface of the base plate means, and b. said tapered projections are similarly disposed respectively on opposite sides of the opening in said scope bracket assembly means to align with the tapered guide openings when the scope bracket assembly means is connected and reconnected to the base plate means.

9. In a detachable zero-set scope mount assembly for hand guns and other firearms wherein said hand guns and other firearms have a frame and standard sights on said frames in the longitudinal line of sight for the given firearm, the combination therewith of;

a. sized base plate means having, a generally upper planar surface, and a lower surface to fit the frame of the given firearm so as not to interfere with the normal use of the standard sights thereon, b. said base plate means including, a centrally disposed threaded bore, and at least one tapered guide opening disposed in the upper surface thereof for precise alignment relative the threaded bore, c. connector means for connecting the center line of said base plate means in the longitudinal line of said firearm, d. scope bracket assembly means having, bracket means for connecting a scope thereon, and a generally planar lower surface to fit the upper surface of the base plate in assembled position thereon, e. said scope bracket assembly means having an opening extending therethrough and at least one tapered projection formed on said lower planar face of the scope bracket assembly means so that in assembled position, said opening is in alignment with the threaded bore in said base plate means and the depending tapered projection is matched, aligned and mated to the at least one tapered guide opening in the base plate means, and f. detachable connecting means in engagement with the scope bracket assembly means and extending through the opening therein for detachable engagement with the threaded bore in the base plate means to connect and reconnect the scope bracket assembly means to the base plate means for use in connection with the operation of the associated firearm and to permit easy removal thereof from the firearm.

10. In the combination as claimed in claim 9 wherein the size of the base plate means and the connecting means thereon complements the situs available for the point of connection to the associated hand gun.

11. In the combination as claimed in claim 9 wherein the connecting means for the base plate means includes, threaded and aligned bores disposed in the center line of the base plate means, and counter sunk threaded members for connecting the base plate means to the associated hand gun.

12. In the combination as claimed in claim 9 wherein said base plate means includes, a. at least one other tapered guide opening spaced from the at least one tapered guide opening and b. at least one other tapered projection disposed on the scope bracket assembly means to align with the said other tapered guide opening when the scope bracket assembly means is connected and reconnected to the base plate means.

13. In the combination as claimed in claim 12 wherein the respective at least one and the other tapered guide openings are respectively disposed on opposite sides of the threaded bore in the base plate means, and the at least one and other tapered projections are disposed on opposite sides of the opening in the scope bracket assembly means to permit alignment therewith in assembled position.

14. In the combination as claimed in claim 9 wherein said at least one tapered guide opening has a cone shaped wall, and said wall is tapered at an angle of about 17° to the axis of the tapered opening.

15. In the combination as claimed in claim 9 wherein;

a. said scope bracket assembly means has spaced bracket holders which define a central space therebetween and the opening communicates at one end with the central space, b. the detachable connector has, an enlarged manual knob thereon disposed in said central space, and c. said bracket means to be mounted in said bracket holders respectively.

16. In the combination as claimed in claim 9 wherein;

a. said scope bracket assembly means includes, an elongated member and said generally planar lower face formed on said elongated member, b. spaced bracket holders formed on said elongated member to define a central space therebetween and said opening having one end in communication with the central space formed in said elongated member, and c. said detachable connector having, an enlarged manual knob thereon disposed in said central space.

* * * * *